United States Patent [19]

Collins et al.

[11] 4,412,607

[45] Nov. 1, 1983

[54] VENDING MACHINE WITH IMPROVED MEANS FOR DISPENSING PRODUCTS AT A PREDETERMINED PRICE

[76] Inventors: Robert J. Collins, Rte. 1, Box 60D, Culver, Oreg. 97734; Erich F. Feigl, 1315 Granville Ave., Los Angeles, Calif. 90049

[21] Appl. No.: 359,471

[22] Filed: Mar. 18, 1982

Related U.S. Application Data

[63] Continuation of Ser. No. 255,170, Apr. 17, 1981, abandoned, which is a continuation of Ser. No. 48,046, Jun. 13, 1979, abandoned.

[51] Int. Cl.[3] ..... G07F 9/04

[52] U.S. Cl. ..... 194/1 D; 194/1 N; 221/21

[58] Field of Search ..... 221/2, 17, 6, 8, 9, 221/15, 21, 124, 125, 129; 194/2, 1 D, 10, 1 M, 1 N; 250/221, 222 R, 223 R

[56] References Cited

U.S. PATENT DOCUMENTS

| | | | |
|---|---|---|---|
| 3,788,333 | 1/1974 | Johnson | 194/1 D X |
| 4,225,056 | 9/1980 | Flubacker | 221/2 |
| 4,252,250 | 2/1981 | Toth | 221/13 |

*Primary Examiner*—Stanley H. Tollberg

*Attorney, Agent, or Firm*—Fulwider, Patton, Rieber, Lee & Utecht

[57] ABSTRACT

A vending machine including a plurality of receptacles in which articles to be vended are stored and releasing mechanisms that selectively release the articles from the receptacles. An enabler counts money or other tender deposition in the machine and enables the releasing mechanisms associated with those receptacles containing appropriately priced articles as successive predetermined totals are reached. The money is temporarily deposited in an escrow chamber from which it is released into a bank only after a sensing device determines that an article has in fact been released.

13 Claims, 5 Drawing Figures

VENDING MACHINE WITH IMPROVED MEANS FOR DISPENSING PRODUCTS AT A PREDETERMINED PRICE

This is a continuation, of application Ser. No. 255,170, now abandoned, filed Apr. 17, 1981, which is a continuation of Ser. No. 048,046 now abandoned, filed June 13. 1979.

BACKGROUND OF THE INVENTION

The present invention relates to vending machines and, more particularly, to electronically controlled vending machines.

A wide variety of vending machines are in common use today, the majority of which are basically mechanical devices. When the proper amount of change has been deposited, a group of actuating levers become operable. Pulling or depressing a lever causes an article to be released from the corresponding receptacle and the article typically falls into an exposed tray.

Some machines that are used to dispense a large variety of products, particularly cigarette vending machines, utilize electric switches each connected to a solenoid that releases products from a particular receptacle. An exemplary solenoid-operated, article-releasing mechanism is described in U.S. Pat. No. 3,722,745.

Vending machines of conventional construction tend to become highly complex as additional functional capabilities are added. Examples of such added capabilities are provisions for dispensing different articles at different prices, provision for preventing more than one article releasing mechanism from being operated at a time and provision for preventing the machine from collecting money when empty.

A common problem with existing vending machines is that they sometimes collect a would-be purchaser's money without dispensing the product. Not only does the potential customer avoid use of the machine in the future, but acts of vandalism may be committed against the machine by an individual who believes he has been cheated.

A common provision for avoiding the collection of a would-be purchaser's money if no product is dispensed is an escrow chamber positioned above the bank of the machine. When coins are deposited, they fall into the escrow chamber where they are held until the product has been dispensed, at which time they fall into the bank. If no product is dispensed because, for example, the machine is empty, the money can be returned since it remains segregated in the escrow chamber.

Previously known mechanisms of this type are not, however, entirely satisfactory because they are built on the assumption that if the releasing mechanism goes through a complete cycle of operation, then an article has been dispensed. In some instances, the product becomes jammed in the machine and is not actually dispensed. In other instances, the machine may fail to detect that a receptacle is empty, allowing the releasing mechanism to operate and causing money to be collected from the escrow chamber even though no article has been dispensed.

It is an objective of the present invention to provide a vending machine that it relatively simple, compact and inexpensively manufactured but overcomes the above-mentioned operational disadvantages of conventional machines.

SUMMARY OF THE INVENTION

One aspect of the present invention resides in a vending machine in which articles are stored in one or more receptacles from which they are dispensed sequentially upon actuation of an article-releasing mechanism and the articles are sensed as they fall. Prior to the release of the article, money or other tender deposited in the machine is temporarily held in an escrow chamber. When the falling article is sensed, the tender is released from the escrow chamber and supplied to a bank until collected. Since the article sensor is responsive to the article itself after it has been released, the escrow chamber will not be activated in response to an actuation or attempted actuation of the releasing mechanism that does not actually result in an article being dispensed.

Preferably, the sensing device includes a light source or other exciter that projects a beam into a photocell. A falling article breaks the beam causing the photocell to signal the escrow chamber that the money is to be released. If the light source should go out of order, it ceases to conduct current, thereby actuating an out-of-order indicator and disabling the machine.

According to another aspect of the invention, a vending machine includes a plurality of receptacles containing articles to be vended, there being at least one receptacle for articles to be vended at a lower price level and at least one receptacle for articles to be vended at a higher price level. An enabler totals the tender accepted by the machine and an enabling device enables the releasing mechanisms associated with the various price levels as the appropriate totals are reached.

Another aspect of the invention relates to a lock out device that prevents repeat operation of the selectors by which the releasing mechanisms are actuated. The lock out device includes a timer which disables the selector for a predetermined time period following the first operation of a selector. If the period elapses with no article having been dispensed, the purchaser can make another selection. The timer and the accumulator are reset by the sensing device if an article is dispensed in the usual manner before the period elapses.

The invention also relates to the use of encoders and decoders interposed between the selectors and the releasing mechanisms. This arrangement reduces the number of conductors that must extend from the stationary selectors to movable drawers of the machine on which the releasing means are mounted.

Other features and advantages of both the apparatus and method of the present invention will become apparent from the following detailed description, taken in conjunction with the accompanying drawings, which illustrate, by way of example, the principles of the invention.

DESCRIPTION OF THE PREFERRED EMBODIMENT

Figure 1:
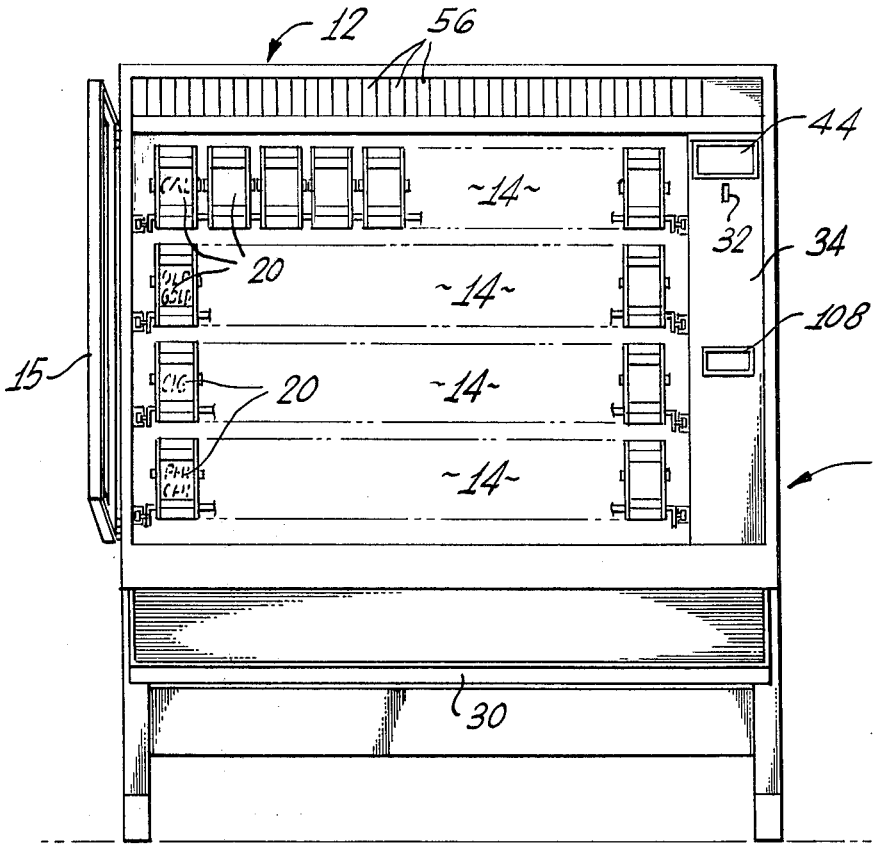
FIG. 1 is a front view of a vending machine constructed in accordance with the present invention, the door of the machine being shown in an open position to expose the drawers and receptacles.
Figure 2:
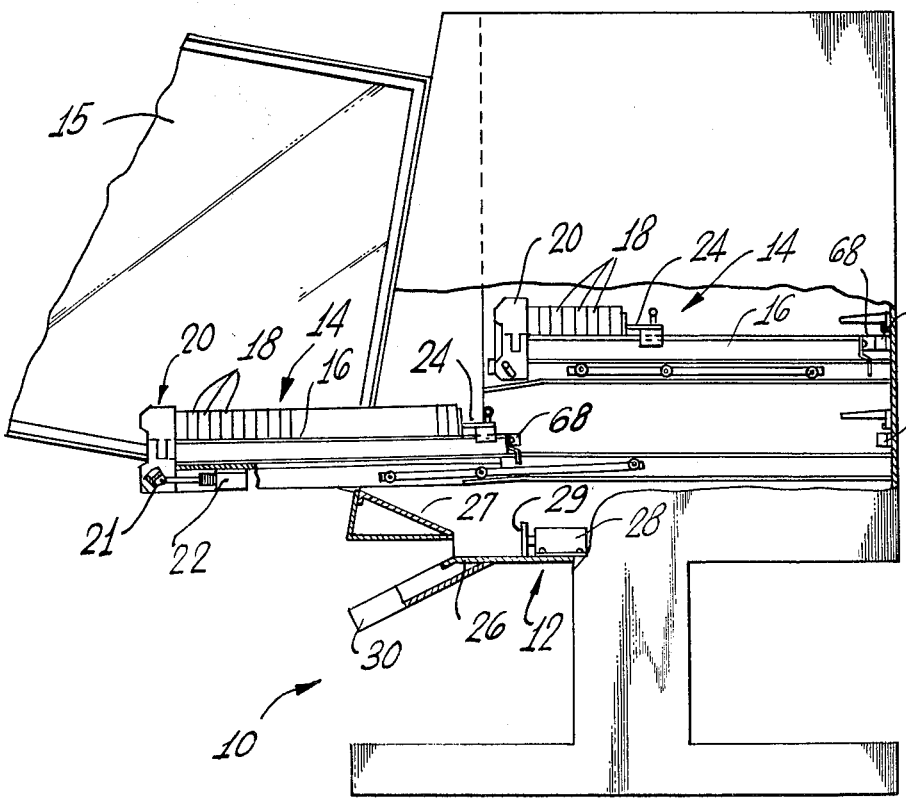
FIG. 2 is a side view of the machine with a part of the cabinet broken away to expose two drawers, one of which is shown in a withdrawn position with a releasing mechanism in an actuated position. A part of the drawer structure is broken away to expose the solenoid of the releasing mechanism.

Many unique and advantageous features of the present invention may be found in the exemplary vending machine 10 illustrated in FIGS. 1 and 2 of the accompanying drawings. Although the invention resides primarily in the electrical aspects of the machine 10, shown schematically in FIGS. 3, 4 and 5, related mechanical aspects of the machine will be described first in general terms as an aid in understanding the environment of the invention.

The machine 10 includes a box-like cabinet 12 in which four drawers 14 are stacked one above the other. Each drawer 14 can be pulled out, once a door 15 on the front of the cabinet 12 has been opened, to expose a row of ten open-topped, trough-like receptacles 16 in which articles 18 to be vended are arranged from front-to-back one behind the other. With the drawer 14 in this withdrawn position, the receptacles 16 can be easily loaded from above.

At the front of each receptacle 16 is a releasing mechanism 20 including an open frame with a trap door 21 that forms part of its floor. A solenoid 22 is mounted on the bottom of the drawer 14 beneath the corresponding receptacle 16 (part of the structure of one drawer being broken away in FIG. 2 to expose the solenoid). When actuated, the solenoid 22 causes the trap door 21 to pivot into an open position while an inter-connected bar (not shown) simultaneously presses downwardly on the top of the article 18 pushing it out through the bottom of the releasing mechanism 20. The remaining articles 18 are then moved to the front of the receptacle 16 by a spring driven carriage 24. In this way, each article 18 can be released from the receptacle 16 sequentially.

When an article 18 is released, it falls onto a shelf 26 at the bottom of the cabinet 12. A baffle 27 extends from the front of the cabinet 12 above part of the shelf 26 so that the article 18 must move horizontally between the shelf and the baffle to escape from the cabinet 12. Another solenoid 28 then operates a dispenser plate 29 that pushes the article 18 off the front of the shelf 26, causing it to fall into a tray 30 beneath the cabinet 12 where the purchaser can conveniently pick it up. The function of the shelf 26 and baffle 27 is to prevent the insertion of any implement from the bottom of the cabinet 12 to extract the articles 18.

An exemplary construction of the cabinet 12, releasing mechanism 20 and associated equipment is described in greater detail in allowed patent application Ser. No. 762,113, filed on Jan. 24, 1977, entitled Article Dispensing Machine, and now U.S. Pat. No. 4,134,520. It will be understood, however, that the invention is not limited to a machine of a particular mechanical construction.

The user of the machine 10 places coins 31 or other tender of suitable denominations in a slot 32 located in a vertical panel 34 that extends along one side edge of the cabinet 12 adjacent to the drawers 14. The coins 31 fall into a coin acceptor 36 (shown schematically in FIG. 3) of the type commonly used in vending machines to separate coins by denomination and reject those that are not genuine.

The coins 31 of each denomination pass through a separate counter 38 and then fall into a common escrow chamber 40 where they are held temporarily. Each counter 38 produces a single pulse when a coin passes through it and is detected photoelectrically. The pulses from each counter 38 are supplied by a discrete line to an accumulator 42 the output of which is a binary representation of a continuously updated total of the amount deposited in the escrow chamber 40.

The binary output of the accumulator 42 is also supplied with three comparison units 44, each connected to a different enabling line 46. Each comparison unit 44 includes a group of manually operable two-position switches that can be set to represent any of a series of binary numbers that correspond to various prices (high, medium and low) at which articles might be vended. When the binary output of the accumulator 42 matches the binary price at which one of the comparing units 44 has been set, that comparing unit produces an output on the corresponding enabling line 46. If the prices at which it is desired to vend the articles 18 change, the comparing units 44 can be easily reset. The accumulator 42 and the comparing units 44 together thus form an enabler that counts the tender deposited in the escrow chamber 40 and produces an enabling signal when one of several predetermined totals is reached.

Each enabling line 46 passes through a separate AND gate 48 where the enabling signal is blocked if it is not coincident with a gating signal supplied to all the AND gates by a common line 50. As explained below, a gating signal is normally present on the common line 50, so the enabling signals normally pass through the AND gates 48 to one of three parallel selector bars 54 that extend across the top of the cabinet 12 behind an array of selector switches 56. Each selector bar 54 is dedicated to one of the enabling signals, high, medium or low, carried by the corresponding enabling line 46.

There are forty selector switches 56, each corresponding to one of the receptacles 16 and its releasing mechanism 20. The switches 56 are divided into four groups of ten, each group corresponding to the releasing means 20 of a single drawer 14.

A would-be purchaser, after depositing a sufficient quantity of coins 31 to cause the accumulator 42 to reach the total required for the article 18 he wishes to purchase, manually closes a selector switch 56 corresponding to the receptacle 14 in which that article is found. A signal from the enabling line 46 that carriers an enabling signal from the accumulator 42 when the total is reached is then conducted by the selector switch 56 that has been closed.

To receive an enabling signal when the required amount has been deposited, the selector switch 56 must be connected to the appropriate high, medium or low selector bar 54. For this reason, each selector switch 56 has an accompanying three position level switch 58. Each level switch 58 is manually preset to make contact with the selector bar 54 that carriers an enabling signal at the price level chosen for the articles 18 in the receptacle 16 to which its selector switch 56 corresponds.

Assuming that an enabling signal is present in the selector bar 54 to which the level switch 58 has been set and the selector switch 56 is closed, current flows to an encoder 60. There is one encoder 60 for each group of ten selector switches 56 and each selector switch is connected to the encoder by a discrete line 61 (In FIG. 3, each set of ten discrete lines 61 is represented by one heavy line. The arrangement is shown in greater detail with respect to one exemplary group of selector switches in FIG. 4). In response to the input from a selector switch 56, the encoder 60 generates a binary decimal number uniquely assigned to one of the ten selector switches 56 that it services.

The output of each encoder 60 is transmitted by four lines or conductors 62 (the number of conductors required to represent the number ten in binary decimal form) to a decoder 64 where the encoding process is reversed. That is, the binary decimal number received results in an output on one of ten discrete lines 66. Since there are four decoders 64, there are forty such discrete conductors 66, each of which carries signals from one selector switch 56 to the corresponding releasing mechanism 20.

It will be noted that the encoders 60 and decoders 64 are well known circuits used for conversion between decimal and binary decimal numbers. Suitable integrated circuit chips for the decoders 60 are available from Fairchild Semiconductor under the designation TTL/SSI 9520/54520, each chip forming a single decoder. Integrated circuit chips for use as the decoders 64 are available from the same source under the designation TTL/MSI 9311.

The advantage of interpositioning the encoders 60 and the decoders 64 between the selector switches 56 and the releasing mechanisms 20 will be understood with reference to the physical layout of the machine 10 (FIGS. 1 and 2). The encoders 60 are stationarily positioned along the top of the cabinet 12, each encoder being adjacent the group of ten contiguous selector switches 56 that it services. The ten releasing mechanism 20 that must communicate with these selector switches 56 are mounted on one of the four drawers 14. if a separate and discrete conductor were run from each selector switch 56 to the corresponding releasing mechanism 20, there would be ten such conductors leading to each drawer 14 for a total of forty such lines in the machine 10. The required wiring harness would be bulky and costly and the wiring problems would be further complicated by the fact that the releasing mechanisms 20, being mounted in the drawers 14, must be movable with respect to the selector switches 56.

The above wiring problems and the associated costs are greatly reduced by the use of the encoders 60 and decoders 64. Each encoder 60 communicates the necessary information to the corresponding decoder 64 on one of the drawers 14 by only four conductors 62 instead of ten and the total number of such conductors running from the vicinity of the selector switch 56 to the drawer 14 is only sixteen instead of forty. Each of these sixteen conductors or lines 62 is divided into two pieces connected by a jack 68 that is automatically plugged into an aligned receptacle 70 at the back of the cabinet 12 when the drawer 14 is in its closed position. When the drawer 14 is pulled out, the jack 68 is automatically unplugged.

When one of the releasing means 20 receives an input from one of the decoders 64, a transistor 70 is forward biased at its base allowing current to flow through a line 72 into the solenoid 22. Actuation of the solenoid 22 then takes place, causing one of the articles 18 to be released. (A single representative releasing mechanism 20 is shown schematically in FIG. 5.)

The machine 10 includes two power supplies, a high voltage power supply 74, and a low voltage power supply 76 that operates off the high voltage power supply through a step-down transformer 78. In this exemplary machine 10, the high voltage supply 74 is at 50 volts and the low voltage supply 76 is at 5 volts. The counters 38, accumulator 42, comparing units 44, encoders 60 and decoders 64 are energized at the low voltage supply 76 while the releasing mechanisms 20 are energized by a capacitive power supply 80 that is charged by the high voltage supply 74. Thus the capacitive power supply 80 discharges through the line 72 when the transistor 70 is forward biased.

Figure 3:
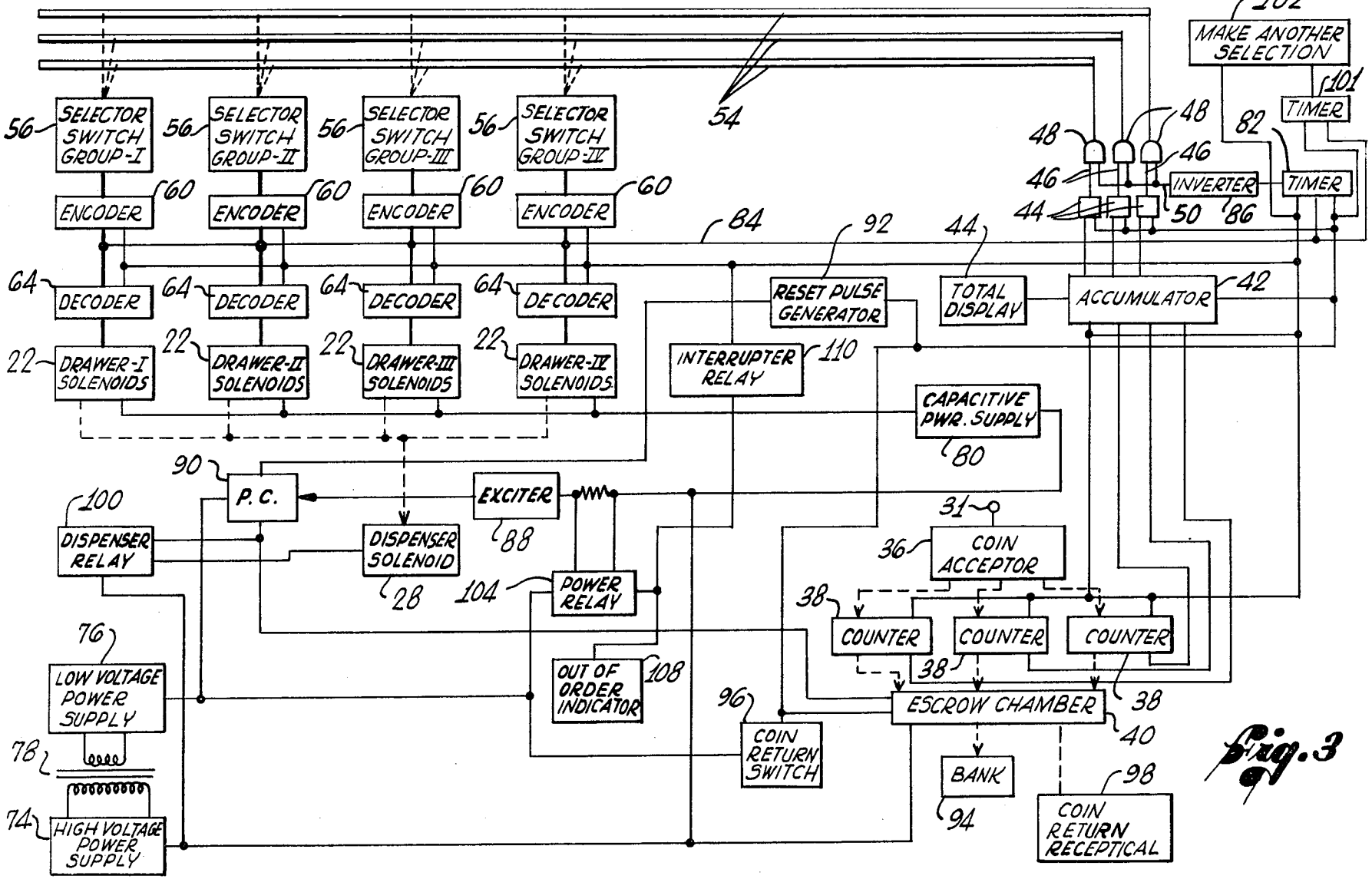
FIG. 3 is a schematic diagram of the electronic circuits by which the machine is operated.
Figures 4, 5:
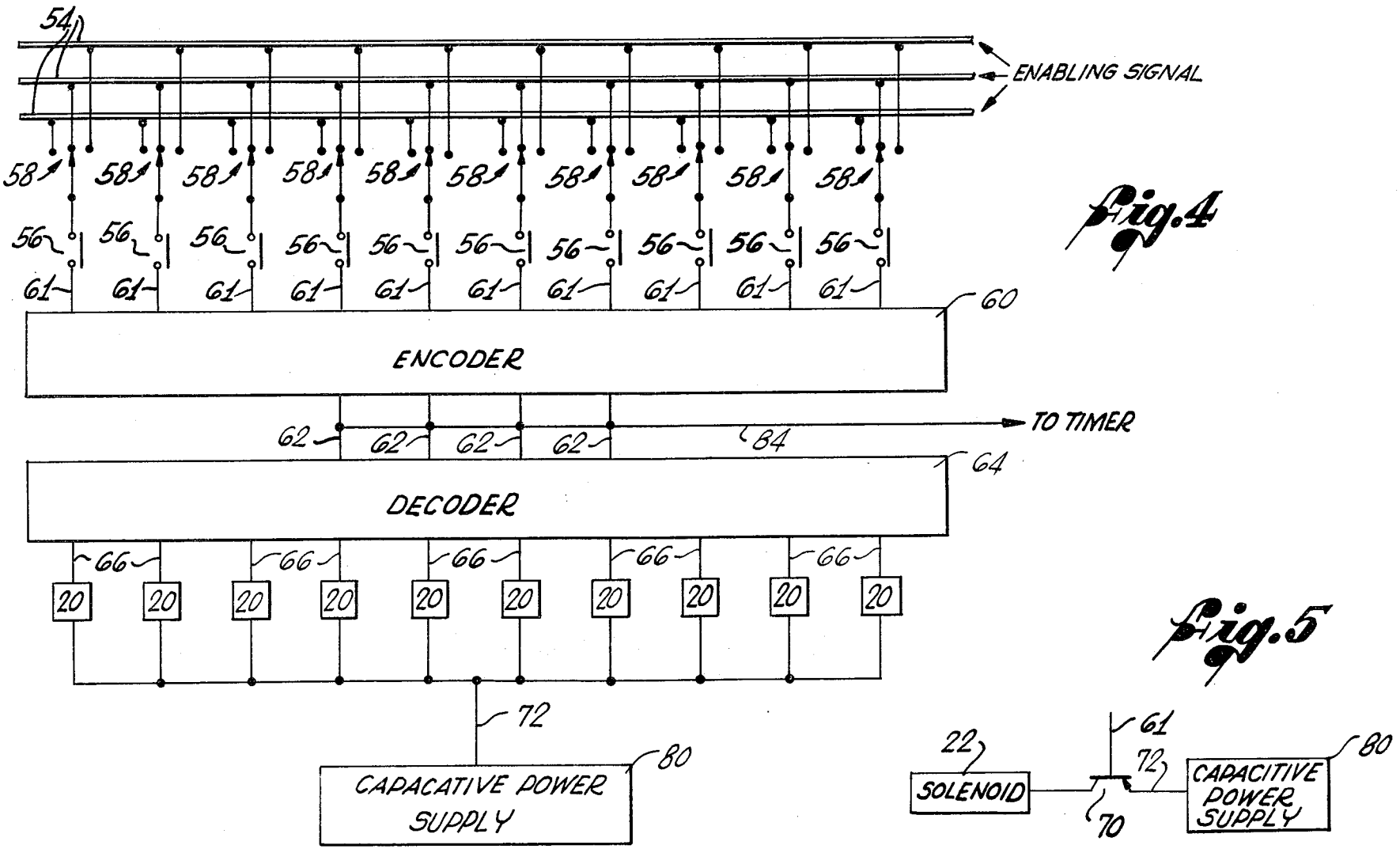
FIG. 4 is a schematic diagram, in greater detail, of a portion of the circuitry relating to a single drawer.
FIG. 5 is a schematic diagram, in still greater detail, of the circuitry relating to a single releasing mechanism.

It will be noted that FIGS. 3–5 of the drawings omit the return connection to the power supplies 74, 76 and 80 to avoid confusion. It should be assumed, however, that all circuit elements are grounded as required.

The capacitive power supply 80 stores enough energy to fire only one solenoid 22, thereby insuring that only one releasing mechanism 20 can be actuated at one time. There are, however, other provisions within the machine 10 that prevent multiple releases, the use of the capacitive power supply 80 being an extra safeguard.

The primary multiple release preventing function is performed by a lock-out device that includes a timer circuit 82 connected by a line 84 to each of the encoder output lines 62. Any output from an encoder 60 sets the timer circuit 82, causing it to generate a blocking signal for a predetermined time period or until it is reset, whichever comes first. The blocking signal is supplied to an inverter 86. When the timer 82 is not generating a blocking signal, the inverter output is the gating signal on the line 50 that is applied to each of the AND gates 48.

As long as this gating signal is present, any enabling signals from the accumulator 42 will be passed through the AND gates 48, permitting the associated selector switches 56 to actuate one of the releasing mechanisms 20. Once a selector switch 56 has been operated and the timer 82 is set, however, the gating signal is discontinued and all enabling signals are blocked at the AND gates 48. In other words, the timer 82, inverter 85 and gates 48 serve to lock out the enabling signal, making it impossible for the purchaser to cause the actuation of a second releasing mechanism 20 once the first selector switch has been operated.

When an article 18 is released, it falls from its receptacle 16 to the shelf 26. As it falls, it passes between an exciter 88, i.e., an incandescent light bulb, and a photocell detector 90. The photocell 90 normally conducts current directly from the low voltage power supply 76 to a reset pulse generator 92, which may be a simple inverter. When the falling article 18 breaks the radiant energy beam from the exciter 88, the photocell 90 is rendered non-conductive for a brief interval and the reset pulse generator 92 supplies a pulse, via a line 93, to the counters 38, the accumulator 42 and the timer 82. The counters 38 and the accumulator 42 are thus reset to zero. The timer 82 ceases to generate a blocking signal so that the gating signal on the line 50 is again applied to the AND gates 48.

The photocell 90 has other functions as well. The interruption of its output actuates the escrow chamber 40 (by a solenoid not shown in the drawings) causing its contents to be emptied into a bank 94 where it will remain until collected. As is conventional in vending machines, the escrow chamber 40 can also be actuated by a coin return switch 96, in which case its contents will be emptied in a different manner into a coin return receptacle 98 when it is accessible to the purchaser.

Operation of the coin return switch 96 also provides an output to the line 93 from the reset pulse generator 92, thereby resetting the counter 38, the accumulator 42 and the timer 82. An additional function of the photocell detector 90 is to activate a dispenser relay 100 that actuates the solenoid 28, causing the released article 18 to be pushed forward off the end of the shelf 26.

The use of the photocell 90 and the exciter 88 is highly advantageous because it enables the machine 10 to sense the falling article 18 itself rather than sensing the operation of the releasing mechanisms 20. This arrangement greatly reduces the likelihood that the machine 10 will collect a would-be purchaser's money from the escrow chamber 40 in the event that no article 18 is actually dispensed. Such failure to dispense could be attributable to an empty receptacle 16, a jamming of the articles 18 in a receptacle or a malfunction of the releasing mechanism 20, among other causes. If, however, an article 18 does not actually fall from the receptacle 16, the beam from the exciter 88 will not be broken, the coins 31 will remain in the escrow chamber 40 and the accumulator will not be reset.

The blocking signal from the timer 82 is generated for only a brief period, i.e., about one-half second, long enough for any released article 18 to be sensed by the photocell 90. Thus, in the absence of the actual release of an article 18, the machine 10 is quickly returned to a condition in which an enabling signal is again applied to one of the selector bars 54 and the purchaser can operate a different selector switch 56.

A second timer 101 is actuated by the output of the encoders 60 on the line 84 and is reset, along with the first timer 82, by the reset pulse generator 92 when an article 18 is dispensed. If, however, the second timer 101 reaches the end of a predetermined interval (the same 0.5 second interval measured by the first timer 82) without being reset, it acuates an indicator 102 that displays the message "make another selection." This message is appropriate whenever the photocell 90 fails to detect that an article 18 has been released in response to a signal from an encoder 60.

Another advantage of the machine 10 is that only one article sensor, the exciter 88 and photocell 90, is required. If the operation of the releasing mechanisms 20 was sensed instead, it would be necessary to have forty separate sensors.

It will be noted that if the exciter 88 were to fail, the accumulator 42 would never be reset and, in the absence of a fail safe device, the various releasing mechanisms 20 could be actuated repeatedly although the price was paid only once. This potential difficulty is overcome by a power relay 104 and a resistor 106 in parallel with each other and in series with the exciter 88 to sense any failure of the exciter. If the exciter 88, an incandescent bulb, were to become inoperative, it would cease to conduct the high voltage current by which it is energized and the voltage drop across the resistor 106 would fall to zero. The power relay 104 would then close, supplying a signal to the illuminated out-of-order indicator 108 and to an interrupter relay 110. The interrupter relay 110 would discontinue the supply of low voltage power to the accumulator 42. Since the signal from the power relay 104 would continue until the condition was corrected, it would be impossible to cause the machine 10 to dispense the articles 18. It would, however, be possible to retrieve coin 31 from the escrow chamber 40 since it is energized by the high voltage power supply 74 and the low voltage to the coin return switch 96 is taken at a point upstream of the interrupter relay 110.

It will be appreciated from the description above that the machine 10 is compact, is inexpensive to manufacture, and requires relatively few parts, but is highly reliable in its operation. While the invention has been described in connection with its preferred embodiments, it will be understood by those skilled in the art that modifications and changes can be made without departing from the spirit and scope of the invention as defined by the appended claims.

I claim:

1. A vending machine comprising:

at least one receptacle for storing a plurality of articles to be vended;

article-releasing means for releasing said articles sequentially upon actuation thereof;

a bank chamber for storing tender;

escrow chamber means forr temporarily holding tender accepted by said machine and for supplying said tender to said bank chamber upon actuation thereof; and article-sensing means for sensing an article that has been released by said article-releasing means and for actuating said escrow chamber in respons thereto, said article-sensing means comprising exciter means for producing a radiant energy beam and means for detecting said beam; and exciter sensing means for sensing whether said exciter means is operative to prevent actuation of said article-releasing means if said exciter means becomes inoperative.

2. The vending machine of claim 1 further comprising means for indicating that said machine is out of order when said exciter sensing means determines that said exciter means is inoperative.

3. The vending machine of claim 1 further comprising:

selector switch means for selectively actuating said article-releasing means upon actuation thereof;

enabler means for counting tender deposited in said escrow chamber and means for enabling said selector switch means when a predetermined total is reached; and lock out means for disabling said selector switch means when said article-sensing means senses that an article has been released by said article-releasing means.

4. The vending machine of claim 3 further comprising selector means for signaling, upon manual operation thereof, that said article-releasing means is to be actuated.

5. The vending machine of claim 3 further comprising display means responsive to said enabler means for visually displaying the total quantity of tender deposited in said escrow chamber

6. The vending machine of claim 1 further comprising:

selector means for producing a signal to actuate said article-releasing means upon operation thereof; and lock out means responsive to operation of said selector means for preventing repeat operation of said selector means upon activation thereof.

7. The vending machine of claim 1 further comprising lock out means for disabling said selector means upon actuation of said releasing means, thereby preventing multiple actuation of said selector means.

8. The vending machine of claim 1 wherein said exciter means comprises a light source and said means for detecting said beam comprises a photocell, said light source and said photocell arranged so that articles released by said article-releasing means pass therebetween; and said exciter sensing means comprises means for sensing whether said light source is operative and for preventing said articles from being released if said light source becomes inoperative.

9. The vending machine of claim 3 further comprising enabler reset means responsive to said article-sensing means for resetting said enabler means.

10. The vending machine of claim 3 and further comprising:

timer means for measuring a predetermined time period following the operation of said selector switch means;

gate means responsive to said timer means for blocking enabling signals produced by said enabler means during said time period; and timer reset means responsive to said article-sensing means for resetting said timer means.

11. A vending machine comprising:

at least one receptacle for storing a plurality of articles to be vended;

article-releasing means for releasing said articles sequentially upon actuation thereof;

selector switch means for selectively actuating said article-releasing means upon actuation thereof;

enabler means for counting tender accepted by said machine and for enabling said selector switch means when a predetermined total is reached;

a bank chamber for storing tender;

escrow chamber means for temporarily holding tender accepted by said machine and for supplying said tender to said bank chamber upon actuation thereof;

article sensing means for sensing that an article has been released by said article-releasing means and for actuating said escrow chamber in response thereto, said article-sensing means comprising exciter means for producing a radiant energy beam and means for detecting said beam;

lock out means for disabling said selector switch means when said article-sensing means senses that an article has been released by said article-releasing means; and enabler reset means responsive to said article-sensing means for resetting said enabler means.

12. A vending machine comprising:

at least one receptacle for storing a plurality of articles to be vended;

article-releasing means for releasing said articles sequentially upon actuation thereof;

selector switch means for selectively actuating said article-releasing means upon actuation thereof;

enabler means for counting tender accepted by said machine and for enabling said selector switch means when a predetermined total is reached;

a bank chamber for storing tender;

escrow chamber means for temporarily holding tender accepted by said machine and for supplying said tender to said bank chamber upon actuation thereof;

article sensing means for sensing that an article has been released by said article-releasing means and for actuating said escrow chamber in response thereto, said article-sensing means comprising exciter means for producing a radiant energy beam and means for detecting said beam;

lock out means for disabling said selector switch means when said article-sensing means senses that an article has been released by said article-releasing means;

timer means for measuring a predetermined time period following the operation of said selector switch means;

gate means responsive to said timer means for blocking said enabling signals during said time period; and timer reset means responsive to said article-sensing means for resetting said timer means.

13. The vending machine of claim 12 further comprising enabler reset means responsive to said article-sensing mean for resetting said enabler means.

* * * * *

UNITED STATES PATENT AND TRADEMARK OFFICE

CERTIFICATE OF CORRECTION

PATENT NO. : 4,412,607

DATED : November 1, 1983

INVENTOR(S) : Robert J. Collins, Erich F. Feigl

It is certified that error appears in the above-identified patent and that said Letters Patent is hereby corrected as shown below:

Col 1, line 65, delete "it" and insert -- is --.

Col. 2, line 18, delete "into" and insert therefor -- onto --.

Col. 4, line 46, delete "carriers" and insert therefor -- carries --.

Col. 8, line 15, delete "forr" and insert therefor -- for --.

Col. 8, line 21, delete "respons" and insert therefor -- response --.

Signed and Sealed this

Twenty-ninth Day of May 1984

[SEAL]

Attest:

GERALD J. MOSSINGHOFF

Attesting Officer

Commissioner of Patents and Trademarks